United States Patent [19]

Grass

[11] Patent Number: 4,690,469

[45] Date of Patent: Sep. 1, 1987

[54] PANEL ADJUSTMENT DEVICE FOR THE FRONT PANEL OF DRAWERS OR THE LIKE

[76] Inventor: Alfred Grass, Konsumstrasse 20, A-6973 Hoechst/VLBG., Austria

[21] Appl. No.: 749,569

[22] Filed: Jun. 27, 1985

[30] Foreign Application Priority Data

Jun. 27, 1984 [DE] Fed. Rep. of Germany ..... 3423732

[51] Int. Cl.[4] ..... A47B 88/00

[52] U.S. Cl. ..... 312/330 R; 312/263

[58] Field of Search ..... 312/263, 204, 330 R, 312/330 SM

[56] References Cited

U.S. PATENT DOCUMENTS

| | | | |
|---|---|---|---|
| 3,416,850 | 12/1968 | Hilfinger et al. | 312/330 R |
| 3,687,512 | 8/1972 | Alston | 312/330 R |
| 3,869,184 | 3/1975 | Lambert et al. | 312/330 R |
| 4,090,753 | 5/1978 | Rock et al. | 312/330 R X |
| 4,120,551 | 10/1978 | Godtschalck | 312/263 X |
| 4,173,380 | 11/1979 | Dupree | 312/330 R |
| 4,230,382 | 10/1980 | Wenzlick et al. | 312/330 R |
| 4,458,965 | 7/1984 | Ohlendorf et al. | 312/204 X |

FOREIGN PATENT DOCUMENTS

| | | | |
|---|---|---|---|
| 30290 | 6/1981 | European Pat. Off. | 312/204 |
| 124059 | 11/1984 | European Pat. Off. | 312/330 R |
| 2321876 | 11/1973 | Fed. Rep. of Germany | 312/330 R |
| 3120555 | 6/1982 | Fed. Rep. of Germany | 312/330 R |
| 3135788 | 8/1982 | Fed. Rep. of Germany | 312/330 R |
| 3120840 | 9/1982 | Fed. Rep. of Germany | 312/330 R |
| 3148066 | 10/1982 | Fed. Rep. of Germany | 312/330 R |
| 639252 | 11/1983 | Switzerland | 312/330 R |
| 1519554 | 8/1978 | United Kingdom | 312/330 R |
| 2143426A | 2/1985 | United Kingdom | 312/330 R |

*Primary Examiner*—Kenneth J. Dorner
*Assistant Examiner*—Thomas A. Rendos
*Attorney, Agent, or Firm*—Rosen, Dainow & Jacobs

[57] ABSTRACT

A penal adjustment device for adjusting the front panels of drawers or the like vertically, laterally and in inclination. The front panel is adjustably connected to a frame piece by a screw flange. The adjustment is carried out by a displaceable adjusting element having one side adapted to press against a pressing surface of the front panel, the other side engaging an associated surface of the screw flange, with an inclined wedge surface of the adjustment element. In order to cover the slot between the front panel and the frame piece, which is dependent on the size of the adjustment, the adjusting element is arranged in a mounting of a U-shaped profile, this mounting being adapted to cover the adjustment gap between the front panel and the screw flange.

13 Claims, 2 Drawing Figures

PANEL ADJUSTMENT DEVICE FOR THE FRONT PANEL OF DRAWERS OR THE LIKE

FIELD OF THE INVENTION

This invention relates to a panel adjustment device for the front panels of drawers or the like, especially for the drawers of kitchen furniture, with frame pieces with drawer guides and side walls, whereby the front panel is mounted on the front ends of the frame pieces to be adjustable laterally, vertically, and in inclination. In such arrangements the connectives adjust to the frame piece by a screw flange. The adjustment is effected by a displaceable adjustment element having one side adapted to press against a pressing surface of the front panel, the other side thereof engaging an associated surface of the screw flange, with an inclined wedge surface of the adjustment element.

BACKGROUND OF THE INVENTION

An adjustment element of this type is disclosed in DE No. 3120840 A1 to the same inventor, wherein a slot is provided between the front panel and the frame piece which is dependent on the size of the adjustment. This slot is unattractive, serves as a repository for dust or dirt, and is unsanitary. This construction also has the disadvantage that the adjustment part is difficulty accessible. A person must perform manipulations inside the drawer. In other respects it is disadvantageous when a person wishes to mount a rail subsequently or immediately, so that special fastening methods are called for. A further disadvantage of this construction is that it is not suited for mass production since, for example, these parts cannot be manufactured by plastic injection methods.

SUMMARY OF THE INVENTION

The object of the invention is to provide a solution and a structure which overcomes these disadvantages.

This object is achieved in accordance with the invention by arranging an adjustment part in a mounting which is, for example, U-shaped such that an adjustment clearance is provided between the front panel and screw flange.

The new construction of the invention lies in the provision of a mounting in which all of the parts required for adjustment and for additional fastening possibilities are integated. The mounting can be made of plastic material. The mounting encases the adjustment parts, and when the front panel is adjusted, an encompassing of the screw flange by the mounting is achieved such that a person is unaware of the gap. The mounting can be constructed in different ways. In accordance with the preferred embodiment the mounting 31 has a U-shaped profile and the side 33 guides the adjustment part 30.

In a U-shaped arrangement the adjustment slot is covered on both sides of the screw flange. However, the mounting can also have an L-shaped construction in order to reduce the cost, in which case the adjustment gap is covered on one side only.

It is also important that the mounting be constructed so that it rises above the frame piece and the adjusting part is arranged in this upwardly extending part. This adjusting part is then easily accessible and constitutes a structural unit, also with further parts, that can be joined to the mounting, so that manufacturing tolerances are satisfied without wasted material, and a streamlined and load-bearing panel adjustment device is possible.

The frame piece and rail can thus be jointly pressed in since this mounting in accordance with a preferred embodiment of the invention is formed as one piece. This yields a substantial savings in fabrication costs. It appears very attractive and this arrangement is also load-bearing, i.e. buckling-resistant. Fabrication inaccuracies can be compensated for by means of the adjusting part. The possibility of an adjustment which can be easily executed by non-professionals is also important. The adjustment requires no special tools, because the adjustment parts can be constructed, since they are visible from above the drawer, so that they can be operated by hand. The adjustment can be executed using only a screwdriver, whereby the bolt is loosened, then the adjustment is made by hand, which can be very exactly controlled, and finally after the adjustment the bolt is tightened using the screwdriver.

It is also possible to adjust in the lateral and vertical directions. Moreover, the rail can be attached at the same time as the adjustable attachment of the front panel. It is particularly important that the invention provides a preassembled unit having the mounting with plugs and adjusting elements, since the mounting integrates, i.e. structurally combines, all of these parts.

BRIEF DESCRIPTION OF THE DRAWINGS

The preferred embodiment of the invention will now be described in detail with reference to the following drawings, wherein.

DETAILED DESCRIPTION OF THE PREFERRED EMBODIMENT

Figure 2:
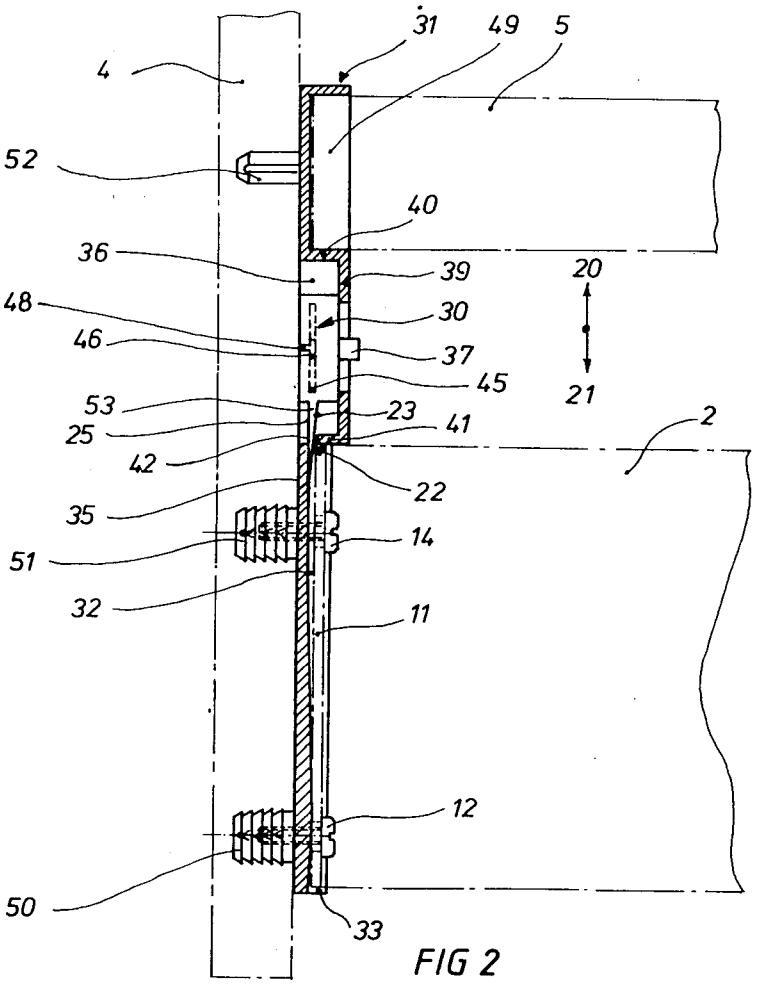
FIG. 2 is a side sectional view of the mounting with the front panel, the frame piece and the rail shown in outline.
Figure 1:
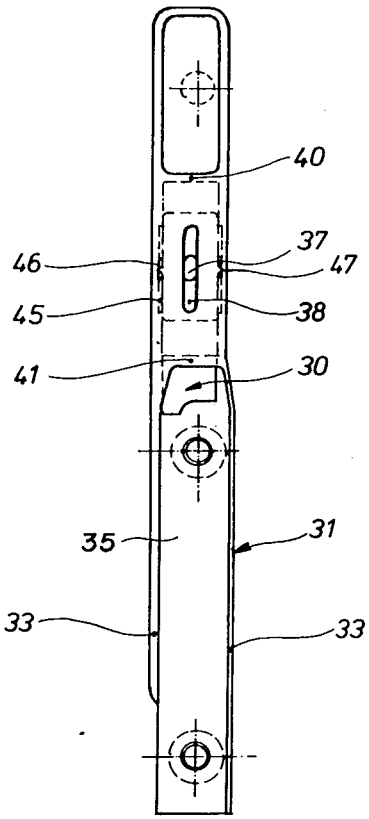
FIG. 1 is a front view of the mounting.

In the drawings it can be seen that the frame piece 2 is connected to the rail 5 and to the front panel 4 by means of the mounting 31 of the invention. The frame piece 2 terminates in a known way in a front screw flange 11. The fastening bolts 12 and 14 connect the drawer guided by the frame piece 2 with the front panel 4 by means of the interposition of the mounting 31. The adjustment part 30 in the preferred embodiment is movable in the adjustment direction 20, 21 and has a wedge surface 23 which is supported by an associated surface 22, so that the front panel 4 will swivel around the lower fastening bolt 12. The front panel 4 is aligned by this means in a known manner. In order that the adjustment gap 32 will be covered, the mounting 31 has a U-shaped profile whereby the flanges or sides 33 of the U-shaped profile cover this gap 32. A recess 36 is provided in the central portion of the base 35 of the U-shaped profile of the mounting 31. A connecting piece 39 forms this recess 36, while being jointly connected by means of a form fit to the sides 33. A slot 38 is arranged in this connecting piece 39, through which the adjusting knob 37 protrudes. In the preferred embodiment the adjusting knob 37 is integrally formed with the guide piece 30. This guide piece 30 is further integrally formed with a wedge-shaped tongue 53. This wedge-shaped tongue 53 protrudes through a slot 42 which is formed in a lower end wall 41, which is in turn integrally formed with the connecting piece 39. An upper end wall 40 integrally formed with the connecting piece 39 serves as an upper limit stop for the guide piece 30. FIG. 2 further shows that the thickness of the profile cross-section of base 35 increases upwardly from the bottom until the first fastening bolt 12 and decreases thereafter. The guide piece 30 is guided in the pilot grooves 45, which are formed in the sides 33 of the U-shaped profile, the projections 46 on the guide piece 30 being slidably guided in the pilot grooves. Recesses 47 are additionally formed in the side walls of sides 33, which recesses run perpendicular to the pilot grooves 45 such that projections 48 of the guide piece 30 engage the recesses for producing a catch. A further recess 49 in the upper part of the mounting 31 serves for receiving the rail 5. Plugs 50, 51, 52 serve to fasten the mounting 31 to the front panel 4.

The operation of the mounting of the invention is as follows: The guide piece 30 can be forced into the recess 36 inasmuch as the mounting is made of plastic, while the sides 33 of the U-shaped profile yield until the projections 46 catch in the pilot grooves 45. This provides the advantage that the parts can be separately prepared and then undetachably arranged in the mounting 31. By means of the further catch—namely the projections 48 in the recesses 47—the adjustment part 30 is locked in its mid-position. This mid-position results, by means of error-free fabrication and error-free installation, in an exactly perpendicular and aligned adjustment of the front panel 4. An upward or downward displacement of the guide piece results in a corresponding correction of the inclination. Such a correction can be realized such that after loosening of the bolt 14 and displacement of the guide piece 30 by means of the adjusting knob 37 in the direction of arrow 20 or 21, a wedge-shaped support surface is built in such a way that a supporting pressure results on the associated surface 22 on the screw flange 11, which brings about more or less swiveling of the front panel 4. It is important that here a support on the forcing surface 25 occurs, which support in this case is provided by the base 35 of the U-shape mounting 31. Following the adjustment, the bolt 14 is tightened. The bolt 12 is not loosened because the front screw flange 11 swivels about the fulcrum formed by the surface gradient of the base. For this reason the thickness of the cross-section of the base 35 must further decrease in thickness above (FIG. 2) the first fastening bolt 12.

The fact that the guide piece 30 is protected against mechanical damage because it is arranged to an extent in a case or cage is also important. The mounting itself can be formed so that it is adjustable to the right and left, or so that it is adjustable only to the right or the left, depending on the constructive embodiment. If one wants to select a different embodiment, then the length of one flange or side 33 of the U-shaped mounting 31 is made longer than the other since one can place the bottom of the drawer on the one side of the mounting.

It is obvious that the mounting can be shortened by making it suitable for use without a rail and can also be lengthened so that a plurality of rails can be arranged above each other. It is important that the mounting is supported on the frame piece 2 and partly embraces it so that a structural supporting unit is available. The width and height of the recess in which the screw flange 11 between the sides 33 is inserted of the U-shaped mounting 31 can be shaped larger than the screw flange so that easy corrections toward the side and top are possible.

It is also important that the plugs, when they are integrally formed with the mounting, can be immediately pressed into the front panel in a single pass, so that the mounting is then securely joined to the front panel. The base of the mounting at the same time serves as the means for establishing the distance between the rail and the frame piece. It is then a very simple fabrication in that the mounting is pressed into or inserted in the front plate, and then at another position the frame piece is assembled with or without the rail. The joining of the frame piece to the mounting follows in a known manner.

What is claimed is:

1. In a panel adjustment arrangement for a front panel of a drawer, said drawer having frame pieces, front screw flanges, drawer guides and side walls, and wherein said front panel is connected to each frame piece by one of said screw flanges, adjustment of position between said front panel and frame piece being effected by a displaceable adjustment element; the improvement wherein the adjustment element includes a wedge shaped tongue having a first tongue surface positioned to press against a surface fixed to said front panel and a surface of said tongue positioned to lie against a surface of the respective screw flange, said tongue between said screw flange and said front panel producing an adjustment gap therebetween, and a mounting in which said adjustment element is movably constrained, said mounting having a U-shaped cross-section including a base and two sides, at least said adjustment gap between said front panel and said screw flange being covered by at least one said side, said sides of said U-shaped cross-section laterally guiding movement of said adjustment element.

2. The panel adjusting arrangement of claim 1, wherein a portion of the mounting extends beyond the associated frame piece, said adjustment element being in this extending portion.

3. The panel adjustment arrangement according to claim 2, wherein said extending portion includes a U-shaped connection piece and said adjustment element comprises an adjustment knob connected thereto, the knob extending through a slit in said U-shaped connection piece.

4. The panel adjustment arrangement according to claim 3, wherein the connection piece comprises upper and lower end walls directed substantially perpendicular to said base, the upper end wall being arranged to serve as an upper limit stop for motion of the adjusting element and the lower end wall having a slit, said wedge shaped protrusion of the adjusting element protruding therethrough.

5. The panel adjustment arrangement according to claim 4, wherein the base includes a first fastening hole and the thickness of the base continuously increases from said slit in the lower end wall of the connection piece to said first fastening hole and continuously decreases beyond the first fastening hole.

6. The panel adjustment arrangement according to claim 5 wherein sides of the U-shaped connection piece are provided with pilot grooves for receiving first projections located on said adjustment element.

7. The panel adjustment arrangement according to claim 6, wherein recesses are arranged substantially perpendicular to said pilot grooves in the connection piece sides, these recesses engaging second projections arranged on said adjustment element.

8. The panel adjustment arrangement according to claim 1, wherein a recess is provided in an extending portion of said base of said U-cross-section of said mounting, said recess longitudinally limiting motion of the adjustment element, said extending portion of said base including a slit, the adjustment element having an adjustment knob extending through said slit in said recess.

9. The panel adjustment arrangement according to claim 1, wherein the mounting comprises a portion extending beyond the frame piece, this portion having means for fastening a rail thereto.

10. The panel adjustment arrangement according to claim 1, wherein the U-shaped cross-section of the mounting forms a recess for receiving an end of a rail.

11. The panel adjustment arrangement according to claim 1, wherein the mounting comprises integral means for connection of a rail.

12. The panel adjustment arrangement according to claim 1, wherein the base of the mounting includes a plurality of plugs for connecting the base to the front panel.

13. The front adjustment arrangement according to claim 12, wherein the plugs are integrally formed with the mounting.

* * * * *